US005343668A

United States Patent [19]

Gonzalez

[11] Patent Number: 5,343,668

[45] Date of Patent: Sep. 6, 1994

[54] SHUTTER ANCHORAGE SYSTEM

[76] Inventor: Alfredo I. Gonzalez, 15941 SW. 83 Ave., Miami, Fla. 33157

[21] Appl. No.: 76,078

[22] Filed: Jun. 14, 1993

[51] Int. Cl.[5] ..... E04B 1/38

[52] U.S. Cl. ..... 52/712; 52/202; 52/208; 52/509; 52/512; 52/DIG. 12; 52/770; 52/506.05; 49/463; 16/87 R

[58] Field of Search ..... 52/202, 208, 506.5, 52/511, 512, 509, 715, 712, 704, 698, 770, DIG. 12; 16/87 R, DIG. 40; 248/231.1; 49/463, 465

[56] References Cited

U.S. PATENT DOCUMENTS

| | | | |
|---|---|---|---|
| 1,340,561 | 5/1920 | Rowan | 52/511 X |
| 1,830,504 | 11/1931 | Carman et al. | 52/203 X |
| 3,214,879 | 11/1965 | Ellingson, Jr. et al. | 52/202 X |
| 4,333,271 | 6/1982 | DePaolo et al. | 52/202 X |

FOREIGN PATENT DOCUMENTS

| | | | |
|---|---|---|---|
| 0494217 | 10/1938 | United Kingdom | 52/202 |

*Primary Examiner*—Carl D. Friedman
*Assistant Examiner*—Robert J. Canfield
*Attorney, Agent, or Firm*—J. Sanchelima

[57] ABSTRACT

An anchorage device for supporting flat cover members for openings in building structures. The device includes two substantially similar stepped-plate members that include each an anchorage section and a supporting section. One of the stepped-plate members may in fact be flat or substantially flat, depending on the termination of the building openings to be protected. The anchorage section includes an opening and a cooperating fastening assembly for readily and removably mounting the device to the building structure with minimal aesthetic detraction or structural alteration. These sections define a plane each and these planes are kept in a spaced apart and parallel relationship with respect to each other by a step wall member. The supporting sections then are kept separate for their respective plates and the separation is sufficient to cooperatively receive the flat cover members that are used to protect the openings. The innermost hole of the supporting member is threaded since it is difficult, if not impossible to reach it. For corners, a modified version is used that include two flat ear members perpendicularly disposed with respect to each other.

12 Claims, 2 Drawing Sheets

SHUTTER ANCHORAGE SYSTEM

BACKGROUND OF THE INVENTION

1. Field of the Invention

The present invention relates to anchorage and to support devices for shutters to be used to protect openings in a building.

2. Description of the Related Art

A number of devices have been designed in the past to provide some degree of protection for the openings in a building. However, most of them require rather elaborate changes in the structure of the opening and/or the peripheral area surrounding the opening to be protected.

The closest reference known to applicant corresponds to U.S. Pat. No. 4,384,436 issued to Green in 1983. However, said reference differs from the present invention wherein the former requires the brackets to be welded to the ironwork protecting the opening with the consequent aesthetic detraction. Therefore, Green's patented invention requires the previous installation of ironwork in the opening being protected.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that can be readily mounted on the periphery of an opening, on the exterior side, to provide the necessary support for the flat cover members to be used to cover the opening.

It is another object of this invention to provide a device that can be readily removed without substantially affecting the aesthetics of the structure and opening being protected.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 2:
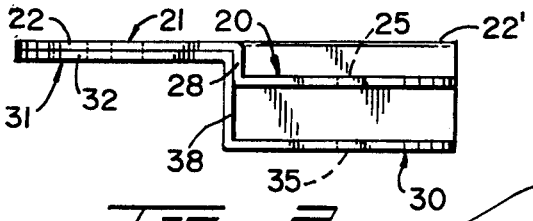
FIG. 2 shows a side elevational view of the plates shown in FIG. 1.
Figure 1:
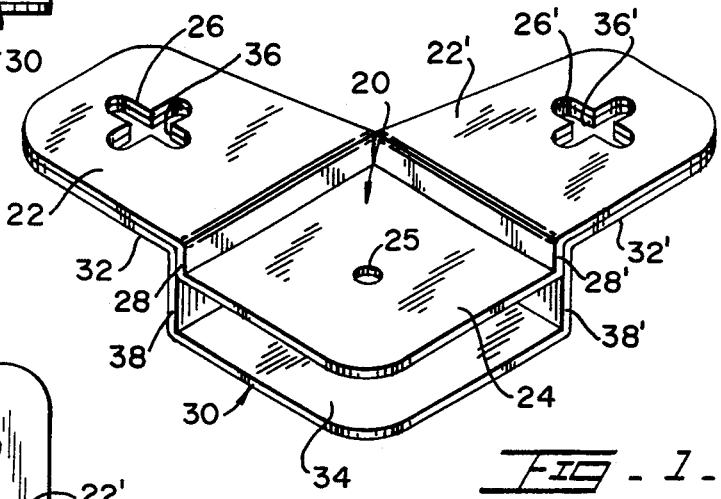
FIG. 1 represents an isometric view of the comer stepped-plates.
Figure 3:
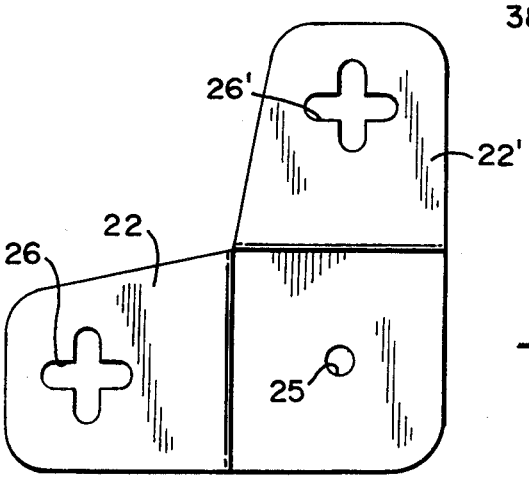
FIG. 3 illustrates a top view of the plates represented in the previous figures.
Figure 7:
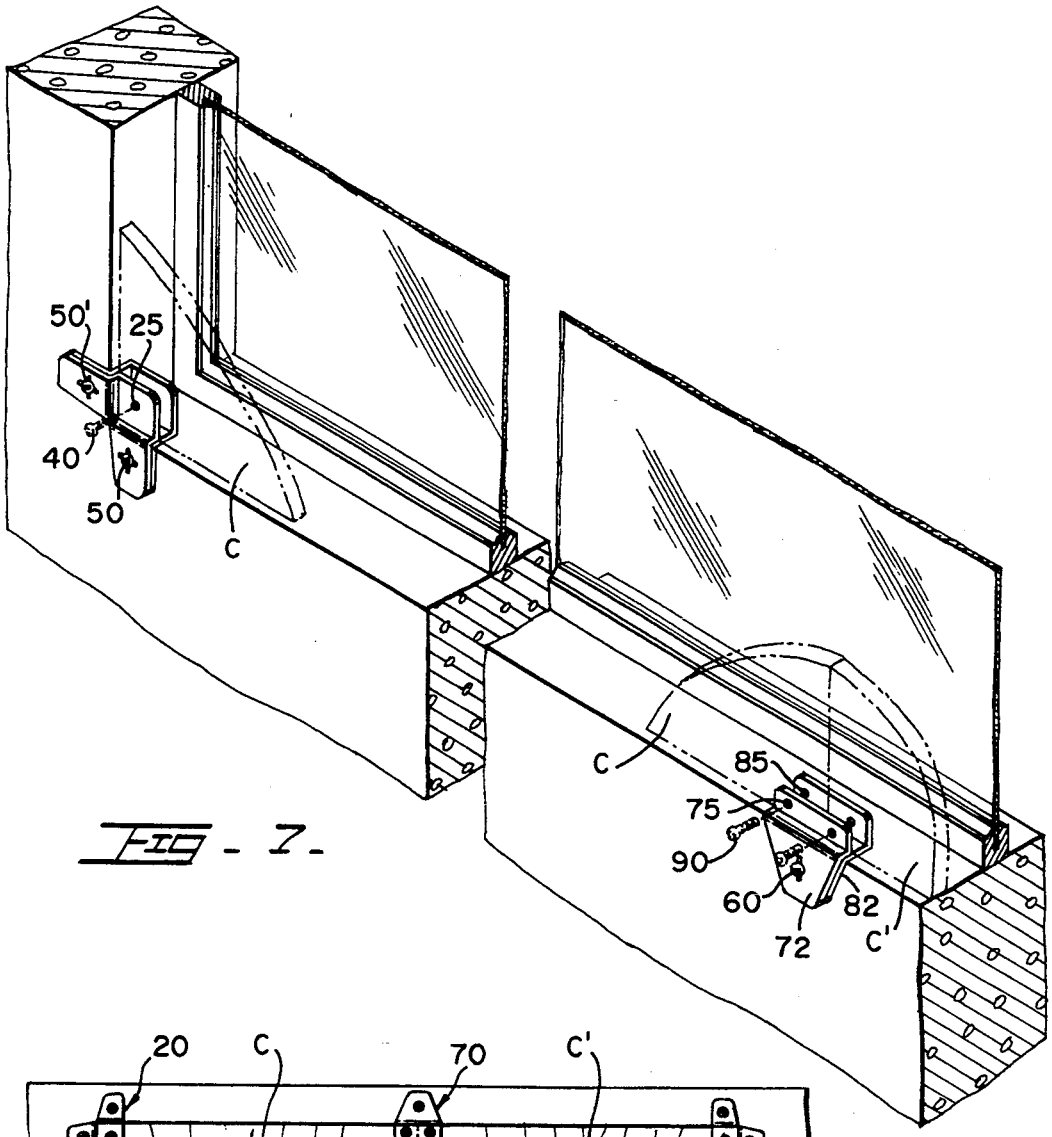
FIG. 7 is a partial broken representation of the sill of a window wherein the corner and side stepped-plates subject of the present application have been incorporated.
Figure 8:
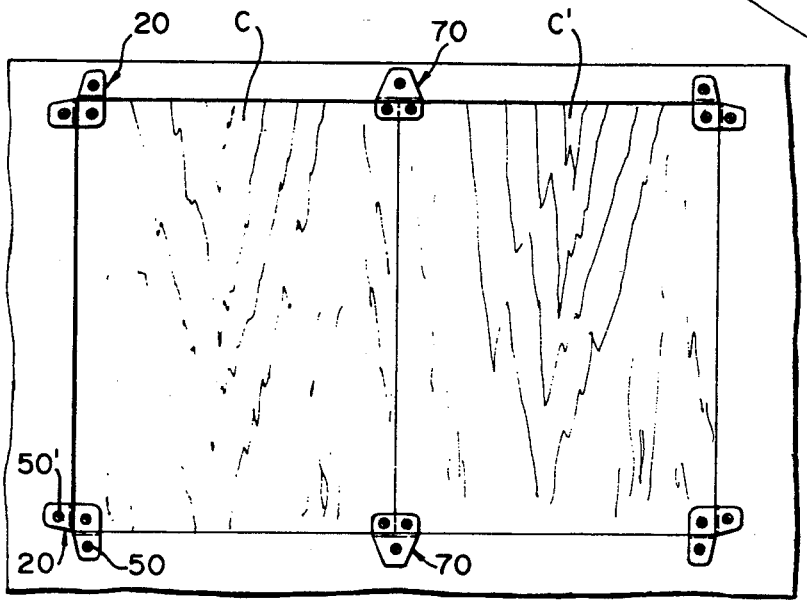
FIG. 8 is a side elevational view of an opening wherein the present shutter anchorage system has been used.

Referring now to FIGS. 1 through 3, where the preferred embodiment of the present invention is shown, it can be seen that it comprises two corner stepped-plates 20 and 30. Corner stepped-plates 20 and 30 are used with the typical rectangular openings found in buildings. Stepped-plate 30 has the deeper step. Corner stepped-plate 20 can, in the case of a perfect opening, be flat and cover member C (shown in FIG. 8) would still be flush with the adjacent wall area that defines the opening being protected. However, it has been found that irregularities found in the openings require a minimum step in plate 20 to insure that cover member C is either inside the opining or flush. If board member C protrudes out it may let the forces in thereby forfeiting the purpose. Plates 20 and 30 have basically two types of sections that are referred to as anchorage sections 21 and 31 and supporting sections 24 and 34. Anchorage sections 21 and 31 for plates 20 and 30 include ear members 22; 22'; 32 and 32', respectively. Step walls 28 and 28' keep anchorage sections 21 and supporting section 24 at planes that are separated and parallel to each other. Similarly, step walls 38 and 38' keep anchorage section 31 and supporting section 34 at planes that are separated and parallel to each other. Step walls 28 and 38 extend different distances so that the difference is sufficient to cooperatively receive flat cover member C, shown in FIGS. 7 and 8. Ear members 22 and 22' are perpendicularly disposed with respect to each other and include cross-shaped openings 26 and 26'. Similarly, ear members 32 and 32' are also perpendicularly disposed with respect to each other and include cross-shaped openings 36 and 36'. Cross-shaped opening 26 and; 26'; 36 and 36' cooperatively allow screw members 50 and 50' through anchor plates 20 and 30 to the wall in the area surrounding the opening to be protected, as best shown in FIGS. 7 and 8. Plates 20 and 30 can be used with openings that include rectangular corners.

The supporting sections 24 and 34 in plate members 20 and 30, respectively, are flat members and include centrally disposed holes 25 and 35. Hole 35 is internally threaded to cooperatively receive bolt member 40 as shown in FIG. 7. This is required because it is not practical or easy to use a nut or other mating device behind plate member 30 after cover members C is position.

Figure 5:
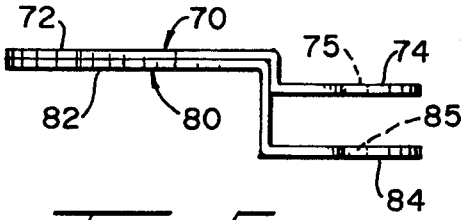
FIG. 5 represents a side elevational view of the side stepped-plates shown in FIG. 4.
Figure 4:
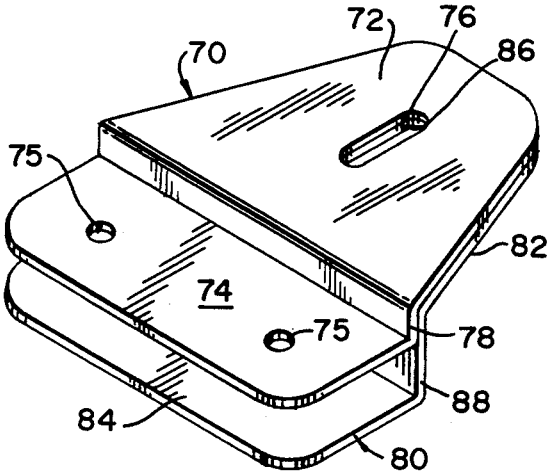
FIG. 4 is an isometric view of the side stepped-plates.
Figure 6:
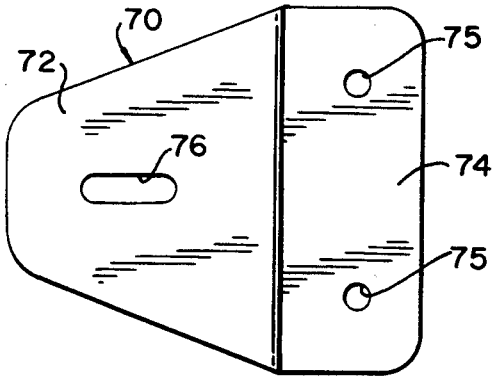
FIG. 6 is a top view of the plates represented in FIGS. 4 and 5.

In FIGS. 4 through 6, side stepped-plates 70 and 80 are shown. Stepped-plate 80 has a step that is deeper than the step of plate 70. As in the case of plate 20, above, the step in plate 70 would be zero (a flat plate) if we know that the opening to be protected does not have irregularities. It is important to ensure that cover members C will not protrude outwardly beyond the exterior plane of the building opening being protected. Otherwise, the wind can come through and lift cover member C. Side stepped-plates 70 and 80 can be used with building openings of any shape, including circular openings, and also in cooperative combination with corner stepped-plates 20 and 30. FIGS. 7 and 8 show one of such uses of cooperative combination of plates 70 and 80 with plates 20 and 30 when the opening being protected is rather large. As it can be readily seen in FIG.

8, side stepped-plates 70 and 80 are mounted at the joint of two cover members C and C′ thereby improving the structural integrity of the two cover members. Cover members C and C′ are typically sheets of plywood that are conventionally and to a maximum width of four feet. Side stepped-plates 70 and 80 have basically two sections that are referred to as flat anchorage sections 72 and 82 that include elongated openings 76 and 86 that cooperatively allow screw members 60 through to anchor plates 70 and 80 to the wall in the area adjacent to the opening being protected. Step walls 78 and 88 extend different distances for the same reason as step walls 28 and 38.

Supporting sections 74 and 84 of side stepped-plates 70 and 80, respectively, include holes 75 and 85. Hole 85 is internally threaded to cooperatively and matingly receive bolt member 90. As with hole 35, this is required because it is not possible to use a nut or other mating device behind flat cover member C.

The foregoing description conveys the best understanding of the objectives and advantages of the present invention. Different embodiments may be made of the inventive concept of this invention. It to be understood that all matter disclosed herein is to be interpreted merely as illustrative, and not in a limiting sense.

What is claimed is:

1. A side anchorage device for supporting adjacent co-planar flat cover members, having a plurality of through holes, to be used in protecting openings of building structures, comprising:

A. first side stepped-plate means having a first flat anchorage section, a first step wall and a flat supporting section, and said first step wall keeps the respective planes of said first flat anchorage section and said first flat supporting section at a spaced apart and parallel relationship with respect to each other, and said first flat anchorage section having at least one opening and said first flat supporting section having at least one hole;

B. second side stepped-plate means having a second flat anchorage section, a second step wall and a second flat supporting section, and said second step wall keeps the respective planes of said second flat anchorage section and said second supporting section at a spaced apart and parallel relationship with respect to each other, and said second flat anchorage having at least one opening and said second flat supporting section having at least one hole and wherein said second step wall being larger than said first step wall so that the planes of said first and second flat supporting sections are sufficiently separated to cooperatively receive said flat cover member when said first and second side stepped-plate means are cooperatively brought against each other;

C. first fastening means cooperatively received by the openings in said first and second flat anchorage sections and said first fastening means being removably mountable to said building structures in an area adjacent to the opening being protected; and D. second fastening means cooperatively received by the holes in said first and second flat supporting sections and adapted to be received by the through holes in said flat cover member thereby urging said first and second flat supporting sections towards each other.

2. The device set forth in claim 1 wherein the hole in said second flat supporting section is threaded to matingly and cooperatively receive said second fastening means.

3. The device set forth in claim 2 wherein the projected shape of said first and second side stepped-plate means is substantially the same.

4. A corner anchorage device for supporting adjacent co-planar flat cover members, having a plurality of through holes, to be used in protecting openings of building structures having rectangular corners, comprising:

A. first corner stepped-plate means having a first flat anchorage section, a first step wall and a flat supporting section, said first flat anchorage section includes two first co-planar flat ear members perpendicular to each other, said flat ear members include each at least one hole, and said first step wall keeps the respective planes of said first flat anchorage section and said first flat supporting section at a spaced apart and parallel relationship with respect to each other, and said first flat supporting section having at least one hole;

B. second corner stepped-plate means having a second flat anchorage section, a second step wall and a second flat supporting section, said second flat anchorage section includes two second co-planar flat ear members perpendicular to each other and said second step wall keeps the respective planes of said second flat anchorage section and said second supporting section at a spaced apart and parallel relationship with respect to each other, and said second flat anchorage having at least one opening and said second flat supporting section having at least one hole and wherein said second step wall being larger than said first step wall so that the planes of said first and second flat supporting sections are sufficiently separated to cooperatively receive said flat cover member when said first and second side stepped-plate means are cooperatively brought against each other;

C. first fastening means cooperatively received by the openings in said first and second ear members and said first fastening means being removably mountable to said building structures in an area adjacent to the opening being protected; and D. second fastening means cooperatively received by the holes in said first and second flat supporting sections and adapted to be received by the through holes in said flat cover member thereby urging said first and second flat supporting sections towards each other.

5. The device set forth in claim 4 wherein the hole in said second flat supporting section is threaded to matingly and cooperatively receive said second fastening means.

6. The device set forth in claim 5 wherein the projected shape of said first and second side stepped-plate means is substantially the same.

7. A side anchorage device for supporting flat cover members, having a plurality of through holes, to be used in protecting openings of building structures, comprising:

A. plate means having a first flat anchorage section and a flat supporting section, and said first flat anchorage section having at least one opening and said first flat supporting section having at least one hole;

B. side stepped-plate means having a second flat anchorage section a step-wall and a second flat supporting section, and said second step wall keeps the respective planes of said second flat anchorage section and said second supporting section at a spaced apart and parallel relationship with respect to each other, and said second flat anchorage having at least one opening and said second flat supporting section having at least one hole and wherein said step wall being sufficiently large so that the planes of said first and second flat supporting sections are sufficiently separated to cooperatively receive said flat cover member when said side plate means and said side stepped-plate means are cooperatively brought against each other;

C. first fastening means cooperatively received by the openings in said first and second flat anchorage sections and said first fastening means being removably mountable to said building structures in an area adjacent to the opening being protected; and D. second fastening means cooperatively received by the holes in said first and second flat supporting sections and adapted to be received by the through holes in said flat cover member thereby urging said first and second flat supporting sections towards each other.

8. The device set forth in claim 7 wherein the hole in said second flat supporting section is threaded to matingly and cooperatively receive said second fastening means.

9. The device set forth in claim 8 wherein the projected shape of said first and second side stepped-plate means is substantially the same.

10. A corner anchorage device for supporting flat cover members, having a plurality of through holes, to be used in protecting openings of building structures having rectangular corners, comprising:

A. corner plate means having a first flat anchorage section and a flat supporting section, said first flat anchorage section includes two first co-planar flat ear members perpendicular to each other, said flat ear members include each at least one hole, and said first flat supporting section having at least one hole;

B. corner stepped-plate means having a second flat anchorage section, a step wall and a second flat supporting section, said second flat anchorage section includes two second co-planar flat ear members perpendicular to each other and said second step wall keeps the respective planes of said second flat anchorage section and said second supporting section at a spaced apart and parallel relationship with respect to each other, and said second flat anchorage having at least one opening and said second flat supporting section having at least one hole and wherein said step wall being sufficiently large so that the planes of said first and second flat supporting sections are sufficiently separated to cooperatively receive said flat cover member when said corner plate means and said corner stepped-plate means are cooperatively brought against each other;

C. first fastening means cooperatively received by the openings in said first and second ear members and said first fastening means being removably mountable to said building structures in an area adjacent to the opening being protected; and D. second fastening means cooperatively received by the holes in said first and second flat supporting sections and adapted to be received by the through holes in said flat cover member thereby urging said first and second flat supporting sections towards each other.

11. The device set forth in claim 10 wherein the hole in said second flat supporting section is threaded to matingly and cooperatively receive said second fastening means.

12. The device set forth in claim 11 wherein the projected shape of said first and second side stepped-plate means is substantially the same.

* * * * *